United States Patent [19]

Walter et al.

[11] 4,034,201

[45] July 5, 1977

[54] STEAM CURLING IRON HAVING INTERCHANGEABLE HAIR WINDING MANDRELS

[75] Inventors: Henry J. Walter, Wilton; Raymond W. Kunz, Monroe, both of Conn.

[73] Assignee: Clairol Incorporated, New York, N.Y.

[22] Filed: Apr. 28, 1975

[21] Appl. No.: 572,098

[52] U.S. Cl. ..... 219/222; 132/33 R; 132/37 R; 132/39 X; 132/40; 132/112; 132/118; 219/225

[51] Int. Cl.[2] ..... H05B 1/00; A45D 1/04; A45D 2/36

[58] Field of Search ..... 219/222–226, 219/271, 275, 274, 273; 132/33 R, 37 R, 39–41, 31, 112, 118

[56] References Cited

UNITED STATES PATENTS

| | | | |
|---|---|---|---|
| 1,510,359 | 9/1924 | Van Gale | 132/33 R |
| 1,591,806 | 7/1926 | Dahlen | 132/37 R |
| 3,135,269 | 6/1964 | Pauldine | 219/222 X |
| 3,215,148 | 11/1965 | Emsellem et al. | 219/225 X |
| 3,224,454 | 12/1965 | Quino et al. | 132/39 X |
| 3,835,292 | 9/1974 | Walter et al. | 219/225 X |
| 3,918,465 | 11/1975 | Barradas | 219/225 X |
| 3,921,648 | 11/1975 | Barradas | 219/225 X |

*Primary Examiner*—A. Bartis
*Attorney, Agent, or Firm*—Sherman & Shalloway

[57] ABSTRACT

An appliance or device for treating hair includes a tubular barrel containing a generator for heat and vapor and a plurality of hair winding mandrels which are selectively slidably mounted over the tubular barrel. The mandrels have different external sizes and configurations, but have interior structures which, though they may differ, allow each mandrel to be used with the same tubular barrel. In one embodiment, the vapor and heat are conveyed from the tubular barrel to the exterior surfaces of the mandrels to treat hair by fins which form ducts within the mandrels that extend radially inwardly toward the tubular barrel. There are apertures both in the mandrels and the tubular barrel with which the ducts register to convey the vapor. Pivoted to each mandrel by means of a sliding pivot is a clip having a clamping portion for initially engaging hair before the hair is wound around the mandrel.

24 Claims, 37 Drawing Figures

STEAM CURLING IRON HAVING INTERCHANGEABLE HAIR WINDING MANDRELS

BACKGROUND OF THE INVENTION

1. Field of the Invention

This invention relates to devices for treating hair with vapor and heat. More particularly, this invention relates to devices for treating hair with vapor and heat by curling the hair around a treating mandrel.

2. Technical Considerations and Prior Art

A widely practiced method of treating hair involves winding the hair around a mandrel or curler and then treating the hair with heat and vapor to plasticize and thereby set the hair. This method is successfully practiced by the device of U.S. Pat. No. 3,835,292. However, the device disclosed by this patent uses a curler or treating mandrel of only one diameter and configuration.

In setting the hair, it is often advantageous to have mandrels or curlers of different diameters and different geometrical configurations to effect different hair styles and to accommodate different types of hair. The prior art does not disclose a hair treating device having mandrels of different diameters and configurations which may be utilized with the type of device disclosed in U.S. Pat. No. 3,835,292. In order to effectively utilize the concept of U.S. Pat. No. 3,835,292 with mandrels of different sizes and configurations, it is necessary that each of the mandrels has a structure that will cooperate with a similar supporting member from which vapor and heat are generated.

Exemplary of the prior art are U.S. Pat. Nos. 3,215,148; 3,224,454; and 3,291,141. Each of these patents teaches using a plurality of mandrels or curlers of different diameters. However, none of these patents discloses adequate structure for conveying a vapor such as steam to the surface of the mandrels.

In addition to providing mandrels or curlers of different diameters, it is also advantageous to have mandrels for waving or straightening hair which are readily interchangeable with curling mandrels. The prior art does not provide for this interchangeability.

Any electrical appliance which utilizes interchangeable components needs a safety switch to render the appliance inoperative while the components are being changed, in order that the user will not be shocked, burned or otherwise injured while the components are being changed or while no component is on the device. This is a special problem with devices such as hand-held steam curling irons which operate from house current and eject steam. The prior art does not concern itself with this problem.

From an operability standpoint, it is necessary to provide each mandrel with a clamp to initially clamp the hair to the mandrel before the hair is rolled up. In order to firmly clamp the hair in place without kinking the hair along the clamping area, it is necessary that the surface of the clamp complements the surface of the mandrel with which it is associated. In the prior art, this is accomplished by telescoping a plurality of rollers together with their treating surfaces in generally tangential relationship at an area near the clamp. This may not be a satisfactory relationship for a hair treating device which utilizes both heat and vapor because the larger diameter mandrels are not coaxial with the tubular barrel around which they are mounted. This eccentricity can conceivably result in an uneven distribution of heat and vapor to the hair wound around the mandrel.

In view of the afore-mentioned limitations and other limitations of the prior art, it is necessary to provide a new and improved device to enable the device of U.S. Pat. No. 3,835,292 to operate effectively with hair treating mandrels of different sizes and configurations.

SUMMARY OF THE INVENTION

Accordingly, it is an object of the instant invention to provide a new and improved device for treating hair with heat and vapor.

Another object of the instant invention is to provide a new and improved device for treating hair with heat and vapor, wherein hair treating mandrels of different sizes and configurations can be utilized.

It is a further object of the instant invention to provide a new and improved device for treating hair with heat and vapor, wherein a single appliance is provided with interchangeable hair treating mandrels.

It is still another object of the instant invention to provide a new and improved device for treating hair with heat and vapor, wherein the device has increased flexibility and utility.

It is an additional object of the instant invention to provide a new and improved device for treating hair with heat and vapor, wherein cylindrical mandrels are provided of different diameters and wherein hair wound around relatively large diameter mandrels is uniformly treated.

It is a still further object of the instant invention to provide a new and improved device for treating hair with heat and vapor, wherein mandrels of different sizes and configurations are provided and wherein clamps are provided to effectively clamp the hair to each mandrel without damaging the hair.

It is yet an additional object of the instant invention to provide a new and improved device for treating hair with heat and vapor, wherein mandrels of different sizes and configurations may be used with the concept of the device disclosed in U.S. Pat. No. 3,835,292.

In view of these and other objects, the instant invention contemplates a hair treating or curling device which includes a means for generating heat and vapor with which to treat hair, a tubular barrel means for containing or defining the heat and vapor generating means, and a plurality of generally tubular mandrels of different sizes and configurations which are selectively slidable over the tubular barrel means. In addition, means are provided for conveying vapor and conducting heat to the mandrels and a handle is provided at one end of the tubular barrel means so that the device may be manually manipulated.

The invention may further contemplate a mandrel for use with the afore-described tubular barrel means, wherein the mandrel has fins extending radially inward therefrom which define ducts that convey vapor and conduct heat from the tubular barrel means to the surface of the mandrel. In addition, the instant invention contemplates a mandrel for use with the afore-described tubular barrel means, wherein the mandrel has an undulating configuration which engages the hair. A cooperating clamp having a complementary undulating configuration is provided to press the hair into engagement with the mandrel. Vapor is conveyed to the undulating surface through apertures therein and heat is conducted to the surface by engaging the fins directly with the tubular barrel means.

Other objects and advantages of the instant invention will become apparent from the following description of the preferred embodiments, taken in conjunction with the following drawings.

DESCRIPTION OF THE PREFERRED EMBODIMENTS

General Illustration of the Invention

Figure 1:
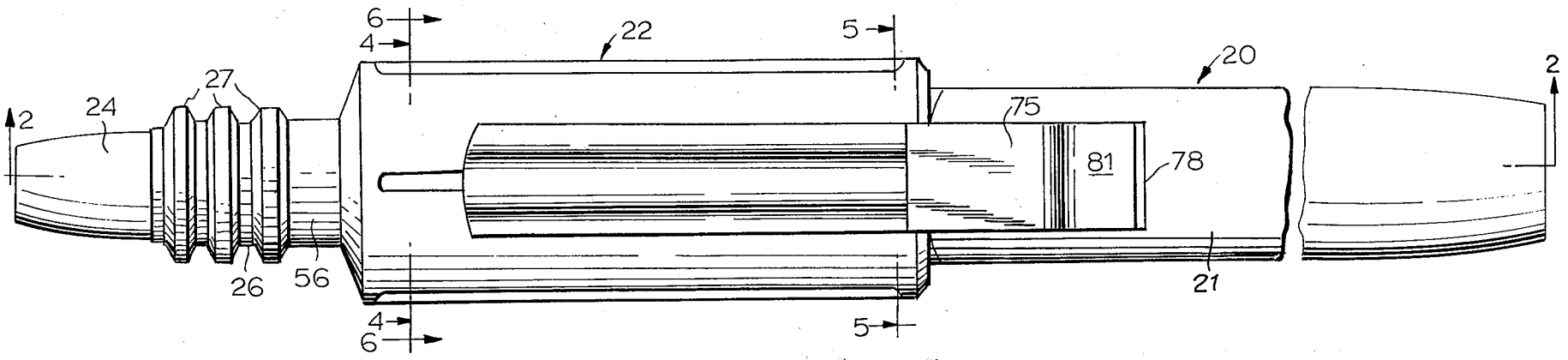
FIG. 1 is a top planar view of a hair curling device according to the instant invention illustrating a basic configuration of such a device.

Referring now to FIG. 1, there is shown a hair curling device, designated generally by the numeral 20, having a handle 21 and a detachable hair treating mandrel, designated generally by the numeral 22. The hair treating device 20 is preferably a steam curling iron which includes some features of the steam curling iron of U.S. Pat. No. 3,835,292, which is incorporated herein by reference. In use, the hair treating device 20 is gripped by the handle 21 and strands of hair to be treated are inserted between a clamp 23 and the mandrel 22. The device is then rotated manually to curl the hair around the mandrel 22. By structure hereinafter described, a button 24 is then depressed to eject steam from the device 20 through the mandrel 22 onto the hair wrapped therearound while, at the same, the hair is being treated by heat which is conducted to the mandrel 22. In accordance with the principles of the instant invention, the mandrel 22 is removable from the device 20 and replaceable by a mandrel of a different diameter or configuration. A finger grip 26 having grippable ribs 27 is supplied for this purpose and is integral with the mandrel 22.

Figure 2:
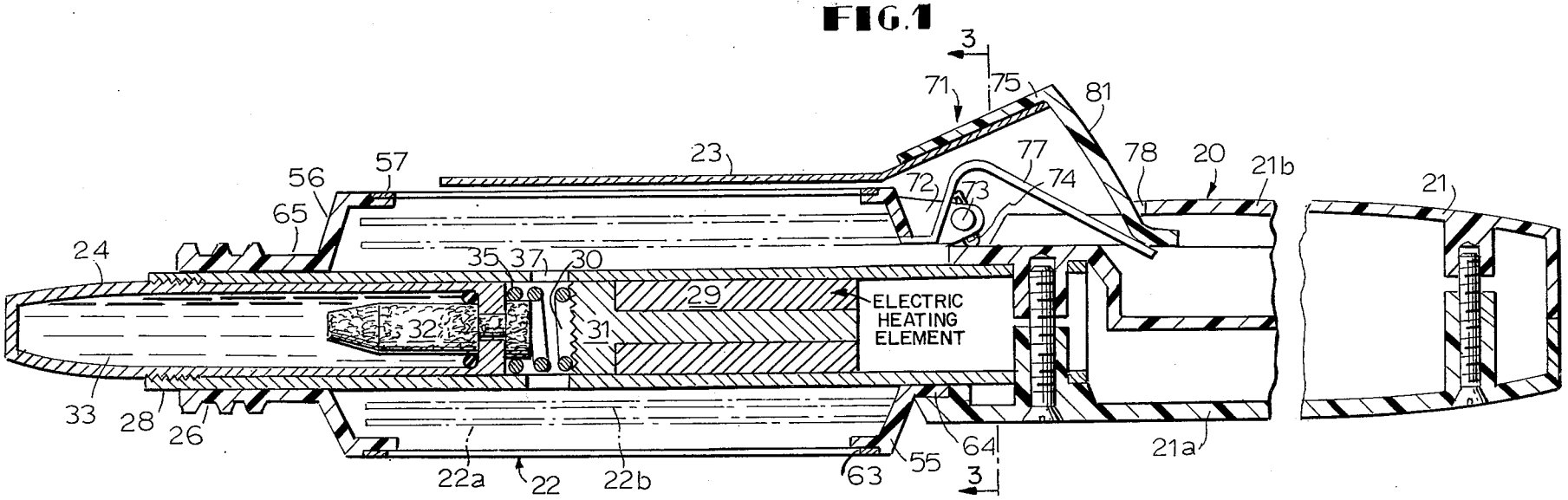
FIG. 2 is a longitudinal section of the steam curling device of FIG. 1 taken along lines 2—2 of FIG. 1.

Referring now to FIG. 2, a plurality of mandrels of different diameters 22, 22*a* and 22*b* are shown. The mandrels 22*a* and 22*b* are shown in dotted lines because only one mandrel is mounted on the device 20 at one time. If it is desired to mount a different size mandrel 22, then the mandrel already on the device 20 must first be removed.

In operation, the heat and vapor or steam are generated in accordance with the principles of U.S. Pat. No. 3,835,292. Accordingly, a metallic tubular barrel 28 is provided to house a heater 29 and a vapor generator, designated generally by the numeral 30. The heater 29 both heats the mounted mandrel 22 and energizes the vapor generator 30.

The vapor generator 30 includes a heat transfer anvil 31 which is in engagement with the heater 29 and a wick 32 which extends into a reservoir 33. The reservoir 33 is filled with water which migrates into the wick 32. The button 24 forms the end of the reservoir 33 and, when pressed, moves the reservoir 33 against the bias of a coil spring 35, thereby engaging the wick 32 with the heat transfer anvil 31. The water in the wick 32 vaporizes and escapes from the tubular barrel through openings or apertures 37 formed therein.

Figure 4:
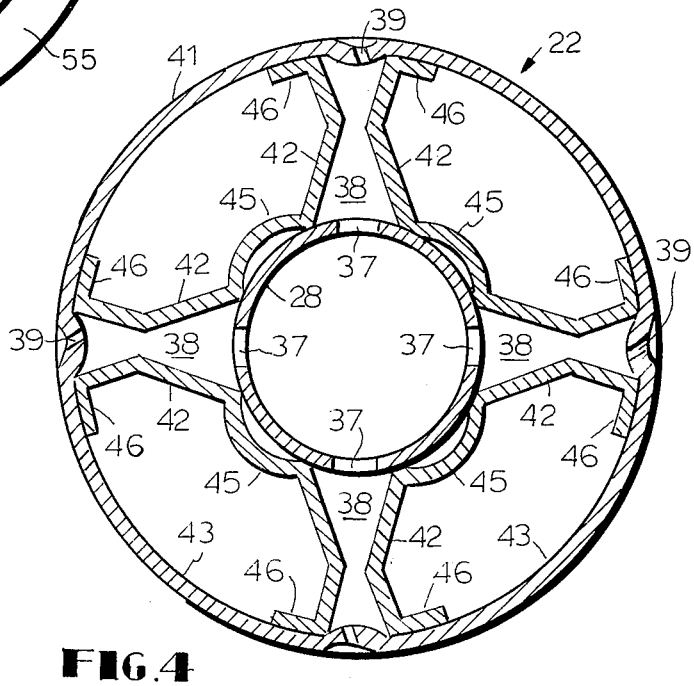
FIG. 4 is an enlarged section of a hair treating mandrel taken along lines 4—4 of FIG. 2.
Figure 6:
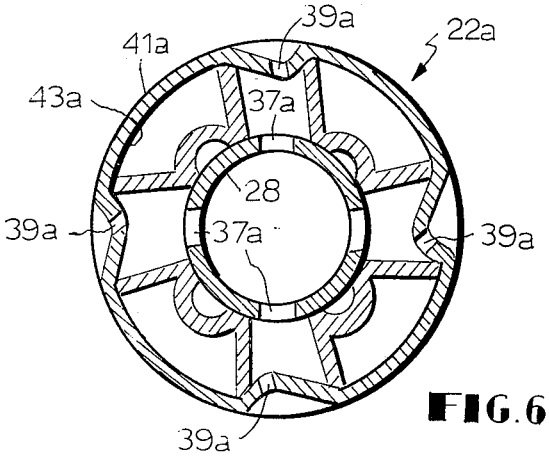
FIG. 6 is an enlarged section of a hair treating mandrel of a relatively small diameter taken along lines 6—6 of FIG. 1.

Referring now to FIG. 4 and FIG. 6, where cross-sections of mandrels 22 and 22*a* of different sizes are shown, the vapor escapes through the apertures 37 into ducts 38 and is conveyed via apertures 39 to the surface 41 of 41*a* of the mandrel mounted on tubular barrel 28. The ducts 38 are formed by fins 42 which extend from the inner surface 43 of the mandrel to define an area at their opposite ends approximating the external dimensions of the tubular barrel 28. In addition to defining the ducts 38, the fins 42 conduct heat from the tubular barrel 28 to the mandrels 22. In order to provide a relatively rigid structure which is also light in weight, the fins 42 of adjacent ducts are joined by arcuate struts 45. The fins 42 are secured to the mandrels 22 by welding or other bonding techniques which insure good heat transfer. In FIG. 4, this is accomplished by welding tabs 46 to the inner surface 43 of the mandrels 22.

The fins 42 are formed preferably of aluminum or an aluminum alloy and have enough resiliency to firmly grip the tubular barrel 28 when slid thereover. Consequently, the fins 42 have sufficient contact with the tubular barrel 28 to conduct heat from the barrel to the mandrel 22 mounted thereon. In addition, the resiliency of the fins 42 provides the means for holding the mandrels 22 on the tubular barrel 28.

As set forth in U.S. Pat. No. 3,835,292, it is important that the vapor or steam emerging from the mandrels 22 not impinge directly on the scalp of the user. Accordingly, the apertures 39 are disposed to direct the vapor obliquely with respect to the radii of the mandrels 22. This is accomplished by having grooves 51 extending in the mandrels 22 which have a long and short wall, wherein the long wall is more oblique with respect to the radii than the short wall. The apertures 39 are then formed in the short wall. In addition, the grooves 51 permit distribution of the vapors when hair is tightly wound around the mandrels 22. It should be kept in mind that the fins 42 extend longitudinally within the mandrels 22 beneath the grooves 51 and that a plurality of apertures 39 register with each duct 38.

Figure 7:
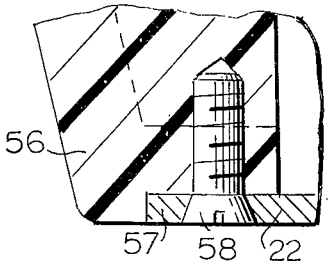
FIG. 7, FIG. 8 and FIG. 9 are enlarged sectional details showing how the end cap of FIG. 5 is attached to the hair treating mandrel of FIG. 6.
Figure 8:
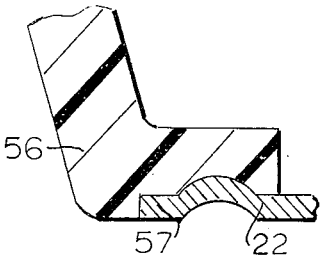
Figure 9:
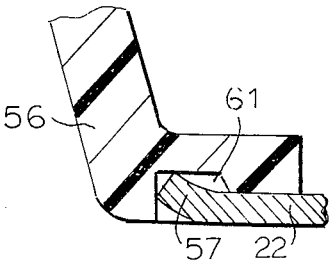

Each mandrel 22 is equipped with first and second plastic caps 55 and 56. The plastic cap 56 is attached to the second end 57 of the mandrel 22 by any of the devices shown in FIGS. 7, 8 and 9. In FIG. 7, it is secured by a screw or rivet 58; in FIG. 8, it is secured to a rib-in-slot arrangement 59; and in FIG. 9, it is secured by an overlapped rib arrangement 61. The same arrangement may be used for the first cap 55 on the first end 63 of the mandrel 22.

The plastic caps 55 and 56 have sleeve portions 64 and 65 extending therefrom which have an inner diameter providing slight clearance around the outer diameter of the tubular barrel 28. Consequently, the mandrels 22 may be slid over the tubular barrel 28 while end caps 55 and 56 are not in contact with the outer surface of the tubular barrel 28. This permits the flexibility of fins 42 to center the mandrel assembly on the tubular barrel 28 and, thus, equalize the pressure between the fins and tubular barrel. As mentioned before, end cap 56 has raised ribs 27 thereon to provide a finger grip portion so that the mandrels 22 may be readily pulled from the tubular barrel 28.

According to the instant invention, the first end cap 55 of each mandrel 22 has a clip, designated generally by the numeral 71, pivoted thereon. The clip 71 includes the metallic clamp 23 which extends therefrom and, as explained previously, initially grips strands of hair between itself and the mandrel 22 prior to rolling the strands of hair around the mandrel. For each mandrel 22, a different clamp 23 is provided which has an arc complementing the cylindrical surface of the associated mandrel.

Figure 3:
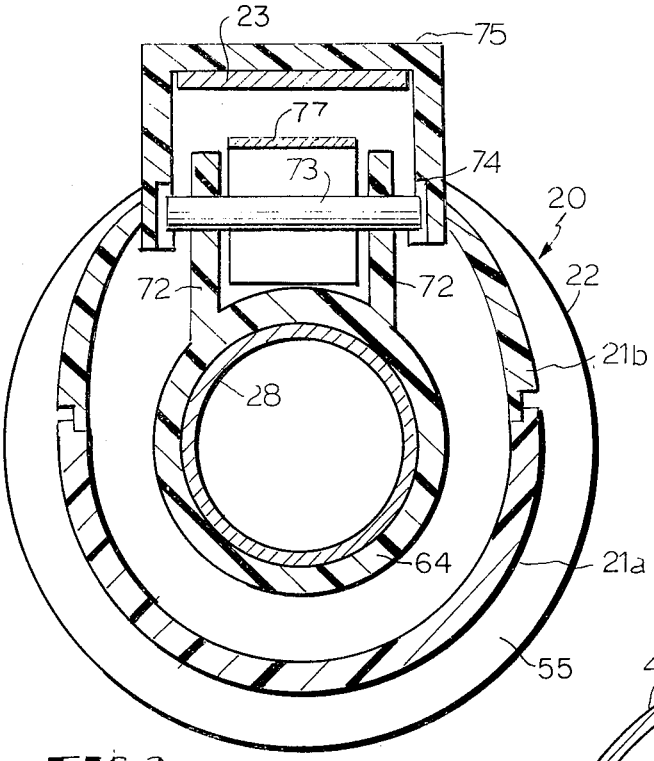
FIG. 3 is an enlarged section of the hair curling device of FIG. 1 taken along lines 3—3 of FIG. 1.
Figure 5:
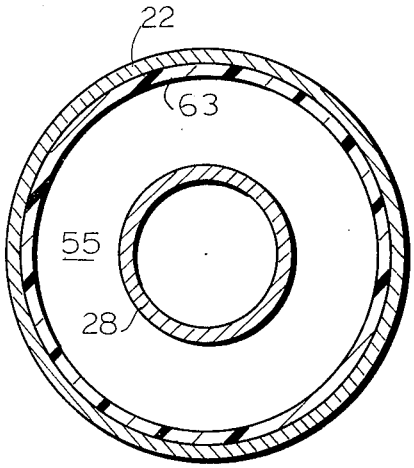
FIG. 5 is an enlarged section of an end cap of a hair treating mandrel taken along lines 5—5 of FIG. 1.

In order to mount the clip 71, each end cap 55 has a pair of spaced flanges 72 projecting therefrom, as perhaps best seen in FIG. 3. These flanges support an axle 73 which, in turn, is registered with a slot 74 in a finger tab portion 75. As seen in FIG. 2, the slot 74 is slightly elongated and extends at an angle oblique to the axis of the device 20. A spring 77 is provided to bias the clip 71 so as to rotate about the axle 73 in a counterclockwise direction with respect to FIG. 2 so that the clamp 23 is urged toward and against the mandrel 22. In order to accommodate the finger tabs 75, the handle 21 has a slot 78 formed therein into which the end of the finger tab 75 projects. The slot 78 is deep enough so that clamp 23 may be lifted sufficiently far above the mandrel 22 to conveniently insert strands of hair therebetween.

After the hair is wound around the mandrel 22 and is set, it is necessary to remove the mandrel from the curl by withdrawing the device 20. Before it can be removed, however, the clamp 23 must be disengaged. This is accomplished by pushing on the rear surface 81 of the finger portion 75 to slide the entire clip 71 to the left with respect to FIG. 2. As the clip slides, it lifts the clamp 23 clear of the mandrel 22 and removes the clamping force from the hair. This is accomplished because the slot 74 rises with respect to the axle 73 as the clip is pushed. The device 20 is then pulled to the right to disengage the curl of hair from around the mandrel 22. As mentioned before, each mandrel 22, 22*a* and 22*b* has its own separate clip 71.

Figure 10:
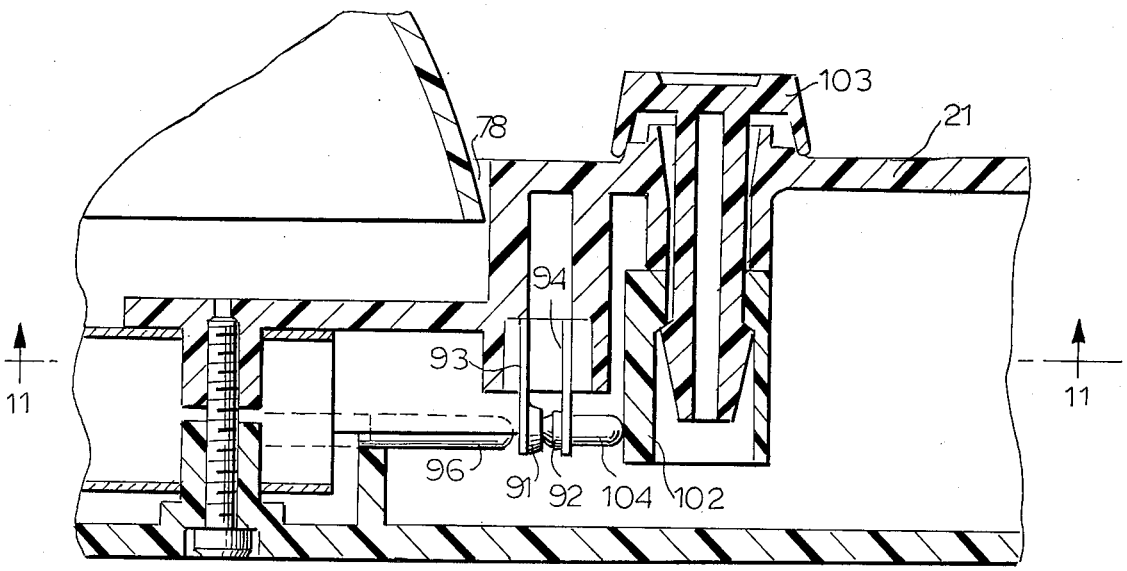
FIG. 10 is an enlarged portion of a sectional view showing an operating switch with a safety device.
Figure 11:
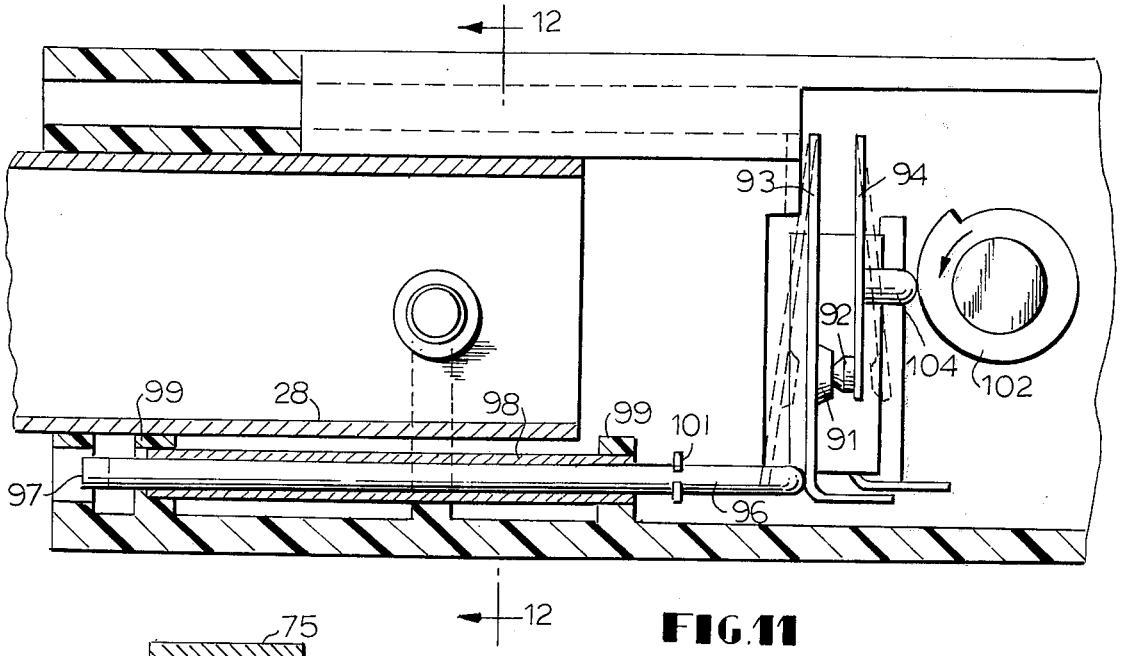
FIG. 11 is a top view of the switch of FIG. 10 taken along lines 11—11 of FIG. 10.
Figure 12:
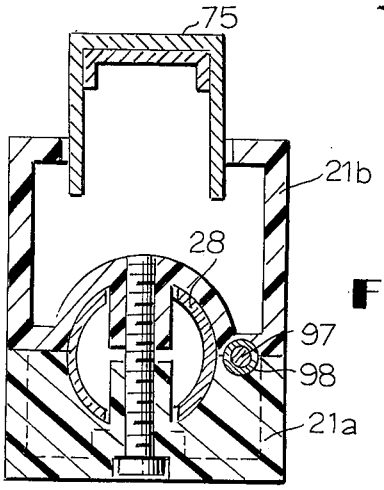
FIG.12 is a section taken along lines 12—12 of FIG. 11.

Referring now to FIGS. 10, 11 and 12, a safety switch is shown for allowing current to flow to the heater 29 (FIG. 2). The safety switch is mounted in the handle 21 and includes a pair of contacts 91 and 92 which, as shown in dotted lines in FIG. 11, are normally biased apart by leaf springs 93 and 94, respectively. When the contacts 91 and 92 are engaged, as shown in FIG. 10, a circuit is completed to energize the heater 29. This is accomplished by conventional means, as is disclosed in U.S. Pat. No. 3,835,292. When the contacts 91 and 92 are apart, as shown in dotted lines in FIG. 11, the circuit is open and the heater 29 is off.

In order to provide the device 20 with a safety feature so that it will not operate unless a mandrel is in place, a push rod 96 is provided which is engaged by leaf spring 93 and biased to the left, as shown in dotted lines in FIG. 11. In order to move the contact 91 to a position where it may be engaged by the contact 92, the push rod 96 must be moved to the right. This is accomplished by sliding a mandrel 22 onto the tubular barrel 28 so that the sleeve 64 projecting from the end cap 55 will engage the end 97 of push rod 96, and thereby slide the push rod to the right. In the illustrated embodiment, the push rod 96 is journalled to slide in a tube 98 supported by flanges 99, and is prevented from dropping out of the handle 21 by a ring 101 secured to the push rod. The spring 93 can urge the push rod 96 to the left only until the ring 101 engages the flange 99.

In order to selectively operate the device 20, a cam 102 is mounted in the handle 21 and is operated by a rotating button 103 projecting to the exterior of the handle 21. The cam engages a follower 104 which projects from spring 94. Upon turning the cam in the counterclockwise direction, as shown in FIG. 11, contact 92 is urged against contact 91 if a mandrel is in place on the tubular barrel 28, thereby energizing the heater 29.

Figure 13:
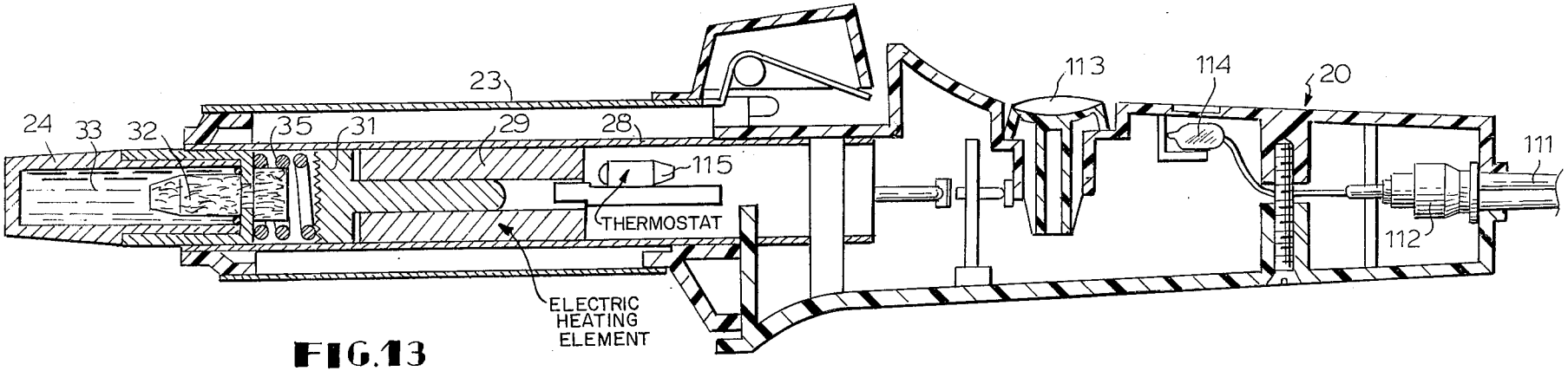
FIG. 13 is a side sectional view of a suggested commercial embodiment of the instant invention showing suggested locations of various associated components.
Figure 14:
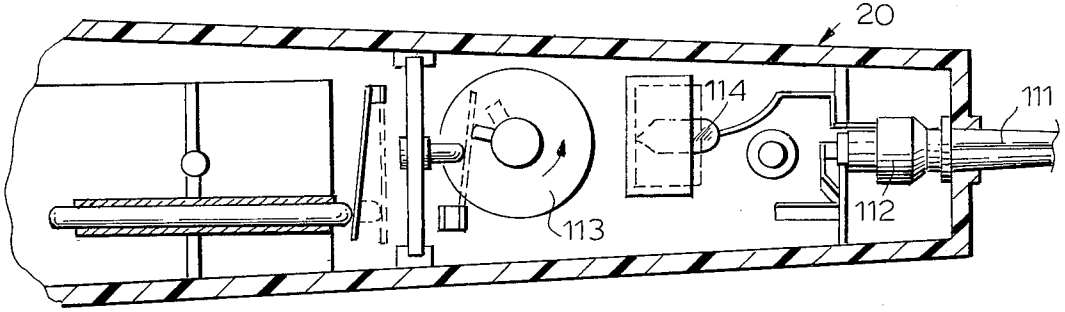
FIG. 14 is a top sectional view of the handle of the embodiment of FIG. 13.

FIGS. 13 and 14 — Suggested Commercial Embodiemnt

In practice, a commercial embodiment of the invention as set forth by the disclosure of FIGS. 1 through 12 might assume the configuration of FIGS. 13 and 14, in which the basic components are shown fully assembled. In FIGS. 13 and 14, the same numerals are used as are used in FIGS. 1–12 to identify similar components.

Power is supplied to the heater 29 and heat transfer anvil 31 by a power cord 111 which is configured to plug into general household electric circuits. Cord 111 is attached to the handle 21 by an electrical connector 112 which is preferably of the type disclosed and covered by U.S. patent application Ser. No. b 451,647, filed Mar. 15, 1974.

The circuit between the heater 29 and connector 112 includes the cam-operated switch shown in FIGS. 10, 11 and 12, an indicator light 114 and a thermostat 115 which is positioned within the barrel 28 proximate the heater 29. The indicator light 114 is preferably lit to show that the appliance is in operating condition only after a mandrel 22 is slid into place over the barrel 28 to engage contacts 91 and 92 (see FIG. 10) and the nob 113 is turned to an "on" position, i.e., rotated counterclockwise as shown in FIGS. 11 and 14. The thermostat 115 is of a conventional bi-metal design and directly senses the temperature of the heater 29. When the heater 29 exceeds the desired temperature level, the thermostat 115 cuts off power to the heater until the heater drops below the desired temperature level. Cycling of the thermostat 115 keeps the heater 29 within the desired temperature range for constant operation.

FIGS. 15 through 19 — Hair Waving and Straightening Embodiments

Figure 16:
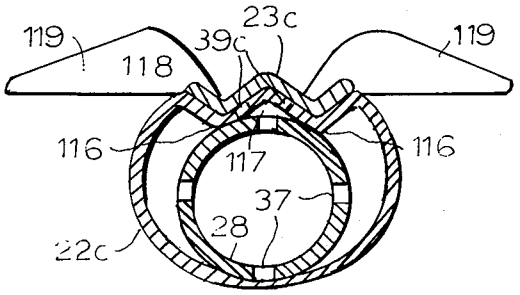
FIG. 16 is a sectional view taken along lines 16—16 of FIG. 15.

In these embodiments in which a mandrel 22*c* cooperates with the clamp 23*c* to form a hair waving or straightening device, the tubular barrel 28 is the same as the tubular barrel of FIG. 2 and operates in the same fashion. However, in these embodiments, the mandrel 22*c* is resilient, having an internal cross-sectional area slightly less than the external diameter of the tubular barrel 28. As seen in FIG. 16, when slid over the tubular barrel 28, the mandrel frictionally engages the barrel directly at points 116 to both secure the mandrel on the barrel and to provide for heat conduction from the barrel to the mandrel. The apertures 39*c* in mandrel 22*c* are not connected to the apertures 37 of the barrel 28 with ducts, but rather the vapor or steam enters space 117 and, from space 117, flows through apertures 39*c*.

As seen in FIG. 16, the mandrel 22*c* now has a treating surface 118 which undulates and resembles a "W". The surface of clamp 23*c* complements the treating surface 118 so as to hold hair tightly in engagement therewith. In addition, the clamp 23*c* may have tines 119 extending from opposite sides thereof to form a pair of combs which serve to align strands of hair as the strands are waved between the clamp 23*c* and treating surface 118.

Figure 15:
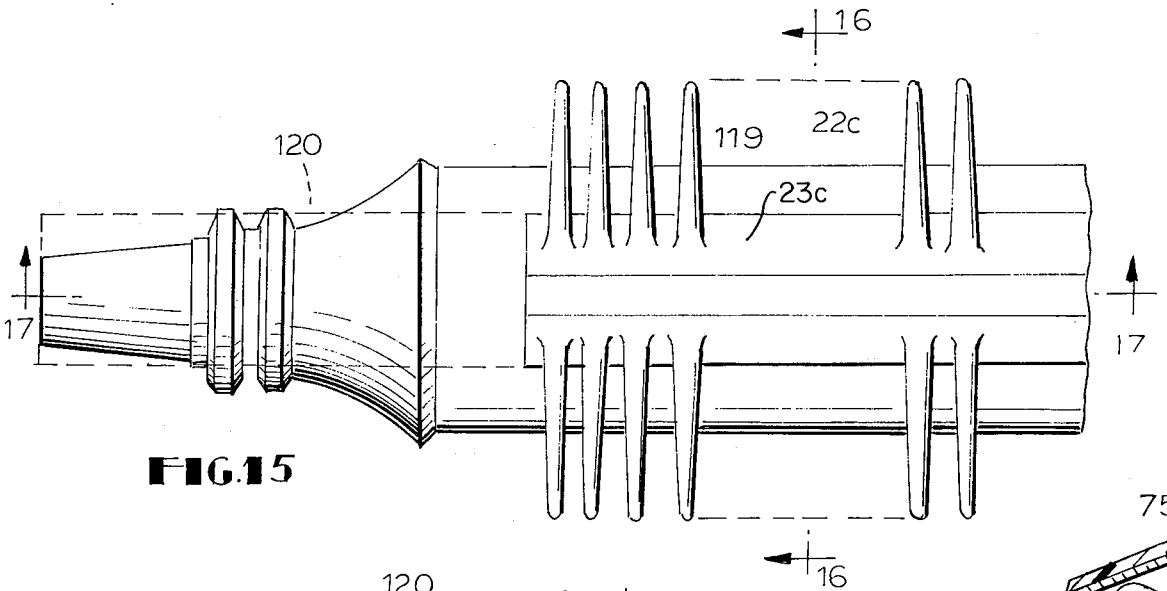
FIG. 15 is a partial top view of another embodiment of the instant invention showing a hair waving and straightening mandrel combined with an optional comb.
Figure 17:
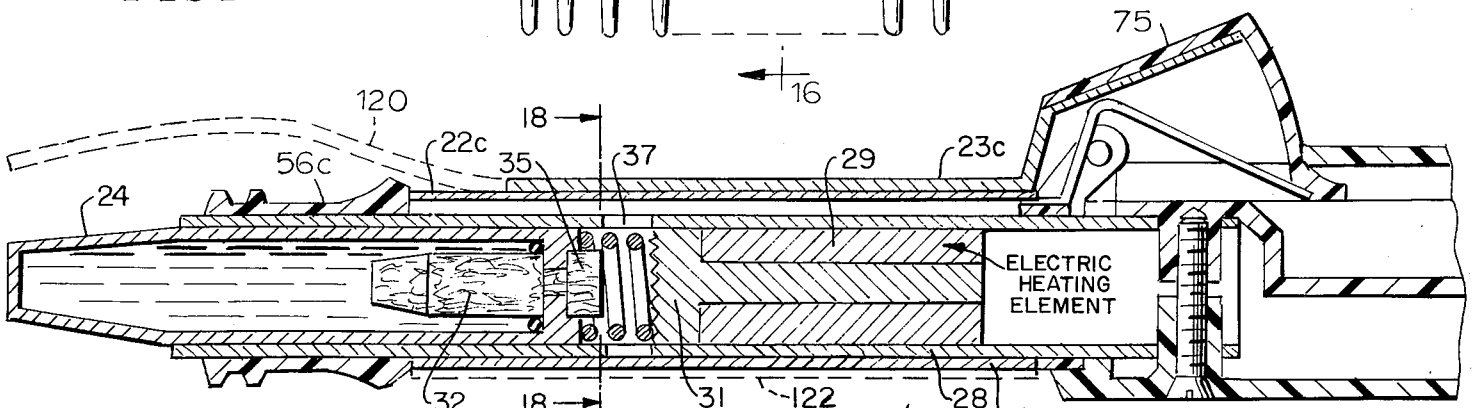
FIG. 17 is a side view in section of a hair waving and straightening mandrel similar to that of FIGS. 15 and 16; however, it is shown not including tines for forming a comb.

As seen in FIGS. 15 and 16, a finger tab 120 may project from the clamp 23*c* in order to control the force with which the clamp holds the hair against the mandrel 22*c*. In operation, the device 20 may be held in both hands, with one hand gripping handle 21 and operating finger portion 75, and the other hand gripping end cap 56*c* and manipulating tab 120.

Figure 19:
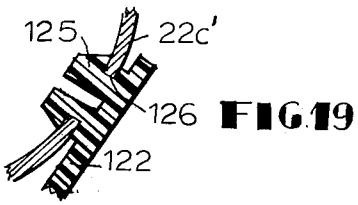
FIG. 19 is a portion of the sectional view of FIG. 17 showing an alternative method of securing a shield to the mandrel.
Figure 18:
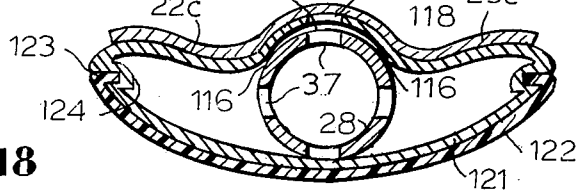
FIG. 18 is a sectional view through lines 18–18 of FIG. 17 showing the mandrel and associated clip with sinusoidal treating surfaces and showing, in addition, an optional heat shield.

Referring now to FIGS. 18 and 19, there is shown a modification of this embodiment in which tines 119 are not utilized in order that hair close to the scalp may be treated with heat and vapor. The tines 119, of course, prevent the appliance from getting close to the scalp. In this modification, a mandrel 22*c*′ is shown with a relatively smooth, sinusoidal treating surface which is complemented by the opposing surface of clamp 23*c*′. As seen in FIG. 18, the mandrel 22*c*′ has a bottom surface 121 which is covered by a shield 122 made of an appropriate type of insulating material. The shield 122 prevents the hot bottom surface 121 from engaging the scalp and burning the user. The shield 122 may be secured in place by lips 123 along opposite edges which fit into grooves 124 in the mandrel 22*c*′. In the alternative, as shown in FIG. 19, the shield 122 may be provided with expanding fasteners 125 which snap into apertures 126 in the mandrel 22*c*′.

Generally in operation, the device or appliance shown in FIGS. 15–19 operates as a hair waving device when hair is clamped between the mandrel 22*c* or 22*c*′ and the clamp 23*c* or 23*c*′ while the appliance is held stationary. The appliance functions as a hair straightening device when the hair is clamped between the mandrel and clamp, and the appliance is moved to continuously draw down strands of hair while the hair is steamed. By using tension, heat and steam in combination with the undulating path provided by the surfaces of the mandrel and clamp, hair straightening is readily accomplished because the undulating surfaces prevent the hair from rolling as it is straightened. By preventing the hair from rolling, while it is treated with heat, steam and tension, the tendency for the hair to curl is eliminated.

FIGS. 20 through 34 — Fin Configurations

Fins 42 which are used to support the mandrels 22 on the barrel 28 may assume many different forms, as seen in FIGS. 20 – 34. It is only necessary that the fins 42 have sufficient resiliency or spring action to hold the associated mandrel 22 on the barrel 28 and that the fins contact both the barrel 28 and the mandrel 22 with sufficient force to ensure conduction of heat from the barrel to the mandrel.

Figure 20:
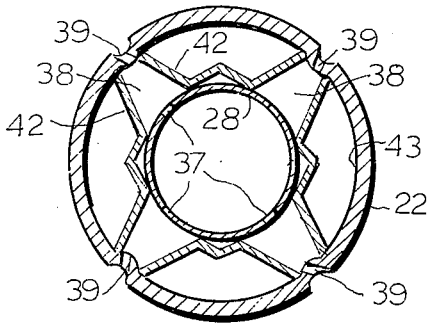
FIGS. 20 and 21 are sectional views showing fins made from generally W-shaped spring members.
Figure 21:
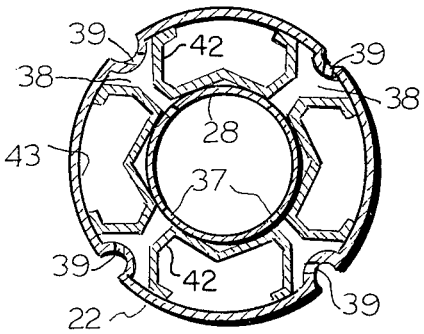

In the group of modifications illustrated by FIGS. 20 – 30, the fins 42 are configured as separate elements which deflect toward the inner surface 43 of the mandrels 22 upon sliding the mandrels 22 over the barrel 28. More specifically, in FIGS. 20 and 21, the fins 42 form legs of "W"-shaped elements. In FIG. 20, the legs of the W-shaped elements forming the fins 42 are straight and spread so that the ducts 38 formed by adjacent legs converge from the barrel 28 to the mandrel 22. In FIG. 21, the legs of the W formed by the fins 42 are bent so that the ducts 38 first converge and then diverge from the barrel 28 to the mandrel 22.

Figure 22:
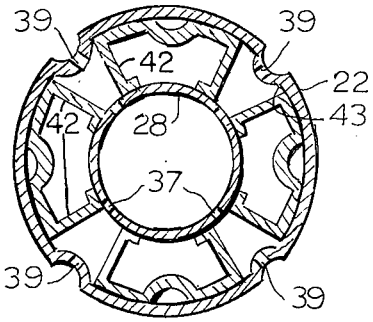
FIGS. 22 and 23 are sectional view showing fins made from generally U-shaped spring members.
Figure 23:
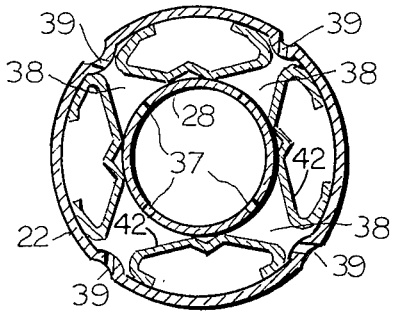

In the modifications of FIGS. 22 and 23, the fins 42 are formed by legs of "U"-shaped members with the ducts 38 formed between the legs of adjacent U-shaped members. In FIG. 22, the U-shaped members have their open ends facing inwardly toward the barrel 28, whereas in the embodiment of FIG. 23, the U-shaped members have their open ends facing outwardly toward the inner surface 43 of the mandrel 22.

Figure 24:
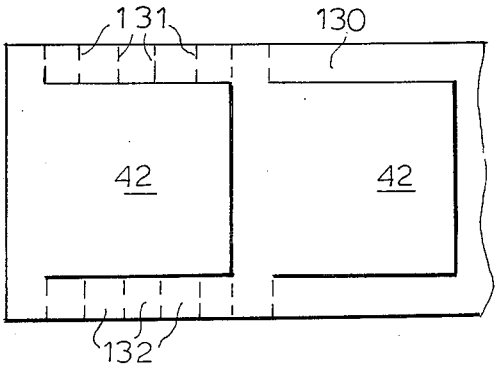
FIG. 24 is a planar view showing how a plate of spring material is cut and creased from subsequent formation into a plurality of fins.
Figure 25:
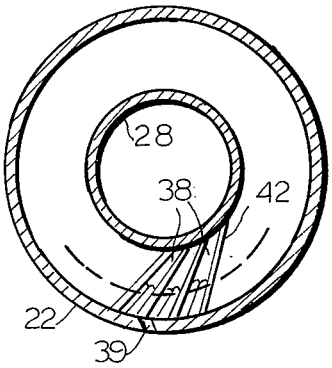
FIG. 25 is a sectional view showing the plate of FIG. 24 folded to form a plurality of fins.
Figure 26:
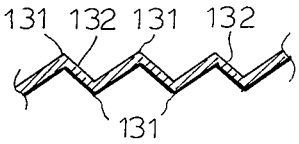
FIGS. 26 and 27 are sectional views showing how the plate of FIG. 24 is folded to form the fins of FIG. 25.
Figure 27:
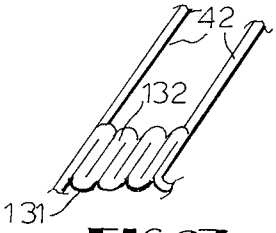

Referring now to FIGS. 24 – 27, another modification is shown in which the fins are formed by a single sheet 130. As seen in FIG. 24, the sheet 130 is cut to form the fins 42 as separate tabs. The sheet 130 is then creased alongs lines 131 and bent as shown in FIG. 26 so as to eventually collapse into the configuration shown in FIG. 27. The portions 132 intermediate the creases 131 then form a spring element which also supports the tabs which form fins 42. When arranged in a circular fashion, as shown in FIG. 25, the fins 42 extend between the barrel 28 and mandrel 22 to form heat conduction paths and to form ducts 38 between adjacent fins. Preferably circular cross-section between the barrel 28 and mandrel 22.

Figure 28:
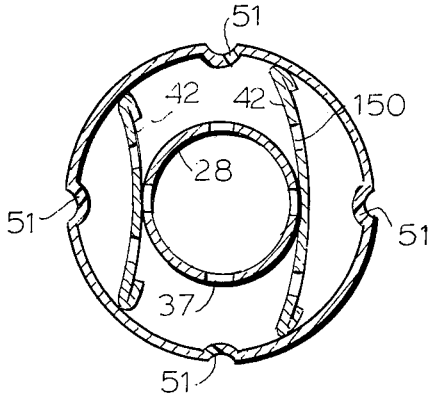
FIG. 28 is a sectional view of an embodiment using a pair of spring members to form heat conducting fins.
Figure 29:
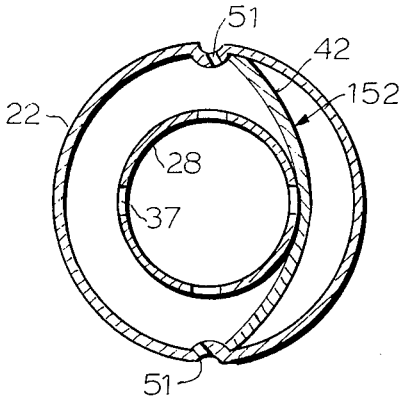
FIGS. 29 and 30 are sectional views of an embodiment using a single spring member to form a heat conducting fin.
Figure 31:
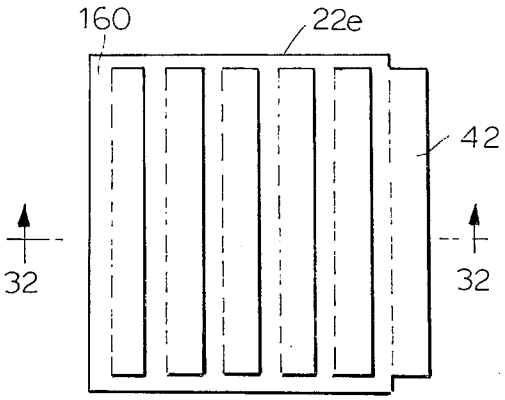
FIG. 31 is a top planar view of a metallic plate which has been cut to form a mandrel with integral fins projecting therefrom.
Figure 30:
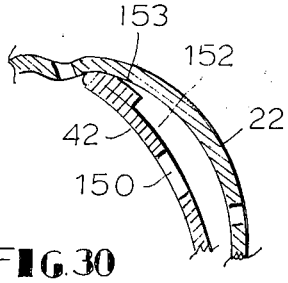

A further modification of the concept of using separate spring members to define the fins 42 is shown in FIGS. 28, 29 and 30, wherein the fins 42 are configured as bowed leaf springs. In FIG. 28, a pair of springs are utilized in which one spring is longer than the other. The springs have apertures or other openings 150 extending therethrough which allow vapor to migrate from openings 37 to openings 39. In the case of FIG. 29, just a single spring 152 is utilized, and in this case, the spring 152 will cooperate with end caps such as end caps 55 and 56 (see FIGS. 1 and 2) to frictionally hold the mandrel 22 on the barrel 28. As seen in FIG. 30, the spring 152 forming the fin 42 may have its end 153 bent over in order to facilitate attachment to the mandrel 22. The arrangement of FIG. 29 is especially suitable for mandrels of relatively small diameter because mandrels having a relatively small diameter do not need as much heat transferred thereto from the barrel 28 as mandrels of larger diameters. In the embodiment of FIG. 29, there are, in effect, only two fins 42 (an upper fin and a lower fin). Two fins will conduct less heat than the eight fins, as shown, for example, in FIGS. 20–23. The optimum number of fins and desired fin configuration are determined by the amount of heat generated in the barrel 28, the amount of vapor generated and the diameter and material of the mandrel 22.

Figure 32:
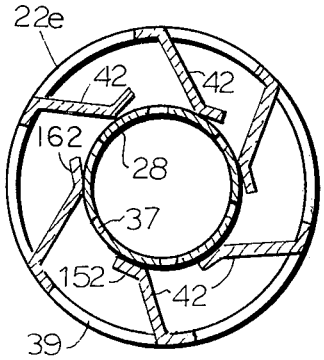
FIG. 32 is a sectional view showing the plate of FIG. 30 rolled to form the mandrel with the fins projecting toward a tubular barrel upon which the mandrel is mounted.
Figure 33:
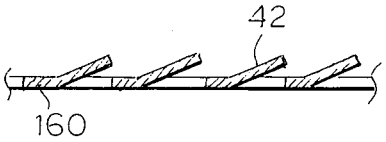
FIGS. 33 and 34 are sectional views of the plate of FIG. 31 showing how the fins are bent to project out of the plane of the plate.
Figure 34:
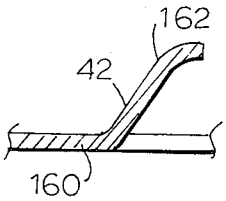

Referring now to FIGS. 31–34, there is shown another embodiment in which a mandrel 22*e* is formed from a flat sheet 160. The flat sheet 160 has the fins 42 formed by U-shaped cuts in the sheet which are bent up from the surface of the sheet, as shown in FIG. 33. As shown in FIG. 34, the fins 42 may then have their free end 162 bent to form a surface for engaging the surface of barrel 28. Upon bending the sheet 160 into a circular configuration, as shown in FIG. 32, a mandrel 22*e* is formed with fins 42 that are integral with the mandrel. The spaces left by bending the fins inwardly form the apertures 39 through which vapor is passed to hair wound around the mandrel 22*e*.

Figure 35:
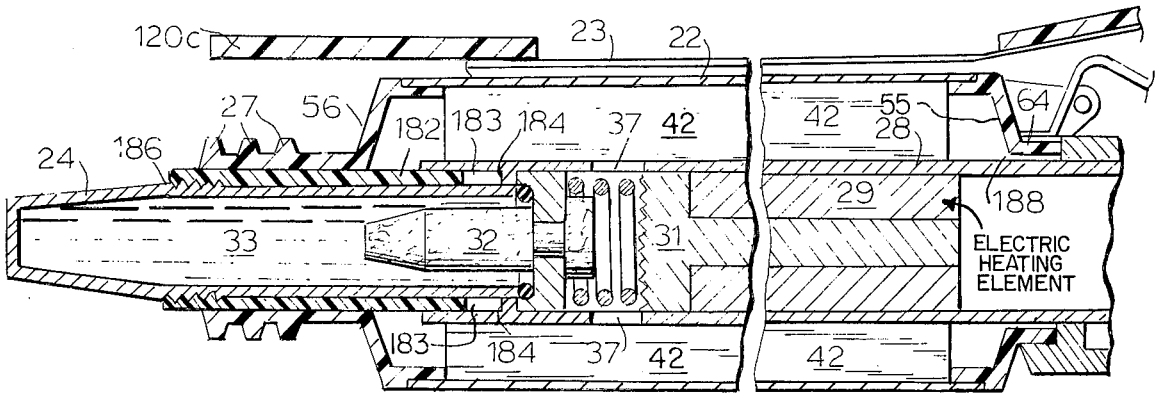
FIG. 35 is a side sectional view showing a preferred approach for a heater barrel structure.
Figure 36:
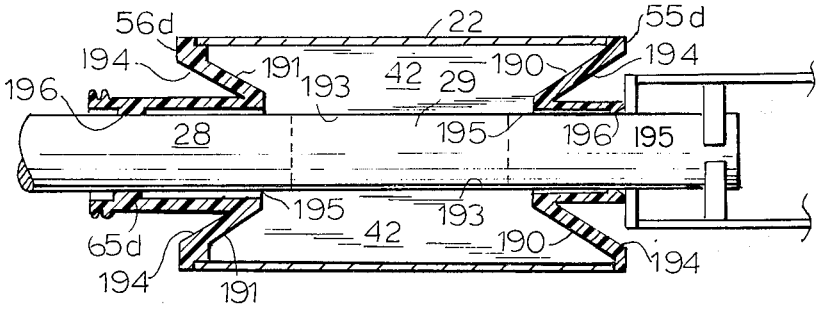
FIG. 36 is a side sectional view showing a preferred fin and end cap configuration.
Figure 37:
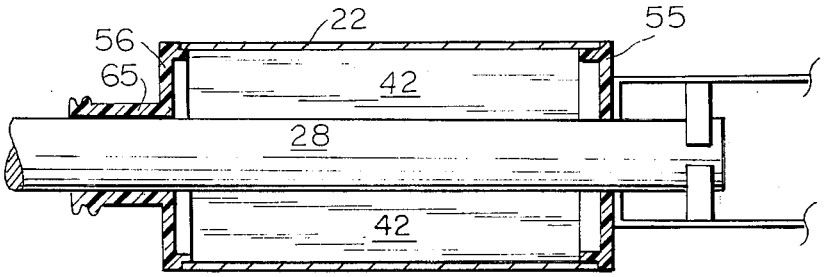
FIG. 37 is a side sectional view showing an embodiment in which the fins are generally rectangular in configuration.

FIGS. 35 through 37 — Structure for Avoiding Heat Transfer Damage

Referring now to FIG. 35, the tube or barrel 28 is made of stainless steel and is assembled with the reservoir 33 by using an intermediate retaining sleeve 182 which preferably is made of a heat resistant plastic. The sleeve 182 has recesses 183 into which tangs 184 depending from the tube 28 project. Cooperation between the recesses 183 and tangs 184 prevents the sleeve 182 from separating from the tube 28.

The sleeve 182 has threads 186 therein which engage with corresponding threads on the button 24. When the button 24 is pressed so as to move to the right, the sleeve 182 is also carried to the right. The button 24 and sleeve 182 slide relative to the tube 28 because the slot 183 is elongated.

Since the sleeve 56 is spaced from the stainless steel tube 28, there is no direct heat transfer therebetween which protects the sleeve 56 from damage due to heat transfer. In addition, the amount of heat transferred to the finger projections 27 is reduced so that the appliance may be comfortably held in one's hand.

Further to this point, the clamp 23 may have a relatively rigid plastic finger tab 120*c* projecting therefrom which may be used as explained in the embodiments of FIGS. 15 through 19. By making the finger tab 120*c* of rigid heat resistant plastic, the clamp 23 may be manipulated by applying and controlling pressure at both ends thereof.

In order to prevent excessive heat transfer to the end cap 55, the end cap 55 is spaced from the stainless steel tube 28, as shown by the space 188. In addition, the ceramic heater does not extend beneath the sleeve portion 64. By the afore-mentioned arrangements, heat transfer to the end caps is controlled to prevent damage to the end caps and injury to the user.

Referring now to FIGS. 36 and 37, an arrangement is shown in FIG. 36 for configuring the fins 42 so as to conform to the shape of the end caps 55*d* and 56*d* while, at the same time, limiting or controlling heat transfer to the end caps. The fins of the preferred embodiment shown in FIG. 36 are tapered so that the edges 190 and 191 thereof converge inwardly and fins engage the barrel 28 only on edges 193. The edges 193 are preferably over the area occupied by heater 29. In the embodiment of FIG. 36, the sleeves 64*d* and 65*d* project outwardly from converging flanges 194 and are spaced by gaps 195 from the barrel 28. The gaps 195 terminate with circular shoulders 196 which closely approximate the diameter of the tube 28 and thereby keep vapor generated from escaping out of either end. By the afore-described arrangement, heat is discouraged from being conducted by the fins to areas of the appliance not adjacent the heater 29 while, at the same time, the surface of the mandrel 22 receives heat along its entire length. In cross-section, the fins 42 may assume any appropriate configuration, such as the configurations exemplified in FIGS. 4, 6 and 20–34. The embodiment of FIG. 37 provides no structure for limiting heat transfer by the fins 42 to areas which either do not need heat or which might be damaged by heat.

The foregoing examples and embodiments are merely illustrative of the invention, which should be limited only by the following appended claims.

What is claimed:

1. A hair device comprising:

a tubular barrel having first and second ends and a predetermined cross-sectional configuration;

heat and vapor generating means within said barrel for heating said barrel and for producing vapor in said barrel;

a plurality of apertures through said barrel for conveying vapor out of said barrel, said apertures being located in spaced relation around said barrel;

a handle portion extending from the first end of the tubular barrel;

a mandrel for winding hair therearound, said mandrel cross sectional area exceeding that of the tubular barrel, wherein said mandrel is removably received over the barrel for replacement by a simularly constructed mandrel having a different hair engaging surface, and wherein said mandrel is generally tubular in configuration about a longitudinal axis, has first and second ends and inner and outer surfaces;

a plurality of passages through the mandrel; and a plurality of resilient fins arranged in pairs to form ducts therebetween which register with the passages in the mandrel, wherein the fins extend from the inner surface of the mandrel toward the barrel and engage the barrel to hold the mandrel in spaced relation with the barrel, and wherein the fins engage the barrel adjacent the apertures of the barrel with the apertures aligned with the ducts so that the vapor in the barrel passes through the ducts and through the passages in the mandrel while the heat is conducted by the fins to the mandrel, whereby hair wound around the outer surface of mandrel is treated with heat and vapor.

2. The hair treating device of claim 1, wherein the mandrel is cylindrical as is replaceable by a similarly constructed mandrel of a different diameter.

3. The hair treating device of claim 1, wherein the mandrel includes end caps mounted adjacent the first and second ends, and wherein the end caps frictionaly engage the tubular barrel adjacent the first and second ends thereof to seal the ends of the mandrel with the barrel.

4. The hair treating device of claim 3, wherein the cap on the second end of the mandrel has gripping means thereon to facilitate removal of the mandrel means from the tubular barrel.

5. The hair treating device of claim 3, wherein the heat and vapor generating means includes an electric heater and a vaporizer energized by heat from the electric heater, said vaporizer including an activating button extending from the second end of the tubular barrel past the cap on the second end of the mandrel to activate the vaporizer when engaged.

6. The hair treating device of claim 5, wherein said vapor generating means is generally cylindrical in cross-section and is slidably received in one end of said tubular barrel and wherein said vapor generating means includes a reservoir surrounded by and positively secured to a retaining sleeve having an elongated recess therein which receives a tang projecting from the tubular barrel to slidably secure the sleeve to the barrel.

7. The hair treating device of claim 6, wherein the reservoir is threadably secured to the retaining sleeve so that the reservoir may be removed for filling with liquid from which vapor may be generated.

8. The hair treating device of claim 1, wherein the mandrel has a hair retaining clip permanently pivoted about a pivot thereon, said clip having a clamping portion extending over and biased toward contact with the outer surface of said mandrel for initially retaining hair between the clamping portion and mandrel prior to winding hair around the mandrel.

9. The hair treating device of claim 8, wherein the clip includes a finger tab integral therewith and extending from the clamping portion, said finger portion releasing the clamping portion from engagement with the surface of the mandrel when pressed.

10. The hair treating device of claim 9, wherein the pivot is an axle which extends normal to the longitudinal axis of the mandrel means and wherein the clip has an angled slot therein which receives the axle and permits the clip to slide with a component away from the axis of the mandrel, as well as to pivot in order to permit convenient removal of the mandrel from the hair wound therearound.

11. The hair treating device of claim 9, wherein the finger tab of the clip is configured to register with a recess in the handle portion to thereby align the apertures in the barrel with the duct means formed by the fins.

12. The hair treating device of claim 1, wherein the heat and vapor generating means is electrically energized and wherein the handle includes an electrical switch means for energizing the heat and vapor generating means, said electrical switch means further having safety means connected therewith which must be engaged and operated by the first end of the mandrel means to energize the heat and vapor generating means.

13. The hair treating device of claim 12, wherein the switch comprises first and second contacts which include spring means to bias the contacts apart and a manually actuated cam for selectively pushing the first contact toward the second contact and wherein the safety means associated with the switch means comprises a slidable rod which, upon being engaged by the mandrel, pushes the second contact into engagement with the first contact to complete an electrical connection.

14. The hair treating device of claim 13, wherein the rod is biased to project from the handle when the device is not in place by the same spring means which urges the second contact away from the first contact.

15. The hair treating device of claim 1, wherein the mandrel has grooves extending therealong which are defined by long and short converging surfaces and wherein the passages through which the vapor emerges from the mandrel extend through the short surfaces and direct the vapor obliquely with respect to the surface of the mandrel means.

16. An interchangeable mandrel for curling hair, wherein said mandrel is configured to be slidably engaged over a tubular barrel of a device from which treating vapor and heat are generated, said mandrel comprising:

a tubular mandrel member having an outer surface for engaging hair;

passages through the outer surface for directing vapor into the engaged hair; and a plurality of fins extending inwardly from the passages and adopted to conduct heat from the tubular barrel to the mandrel member, said fins being arranged in pairs which form open end duct means for conveying vapor to the passages and said duct means terminating to define a space approximating the exterior dimensions of the tubular barrel wherein the fins are adopted to removably hold the mandrel member in spaced relation with respect to the tubular barrel.

17. The interchangeable mandrel means of claim 16, wherein grooves extend along the outer surface of the mandrel member, wherein the grooves are defined by long and short converging surfaces and wherein apertures define the passages through which the vapor emerges and said apertures extend through the short surfaces and direct the vapor obliquely with respect to the surface of the mandrel member.

18. The mandrel means of claim 16, wherein the mandrel member is cylindrical in configuration.

19. The mandrel means of claim 16, further including caps mounted on each end of the mandrel member, wherein each cap has a sleeve attached thereto which is adopted to cooperate with the outer surface of the barel to discourage the escape of vapor from the space between the mandrel member and the barrel.

20. The mandrel means of claim 18, wherein one of the caps includes raised ribs thereon to facilitate gripping the cap to remove the mandrel member from the tubular barrel.

21. The mandrel means of claim 16, wherein a clip is pivoted on said mandrel member and wherein the clip has a clamp for initially holding hair in engagement with the outer surface of the mandrel member prior to winding the hair thereabout and wherein the clip further has a finger tab for operating the clamp.

22. The mandrel means of claim 21, wherein the clamp and finger tab are integral, said mandrel member further including biasing means for urging the clamp toward the surface of the mandrel member and a sliding pivotal connection between the mandrel member and clip to allow the clamp to be spaced from the surface of the mandrel member without pivoting the clip.

23. The interchangeable mandrel means of claim 16, wherein the fins means are formed from metallic spring elements.

24. The interchangeable mandrel means of claim 23, wherein the metallic spring elements are generally W-shaped in configuration.

* * * * *

UNITED STATES PATENT OFFICE

CERTIFICATE OF CORRECTION

Patent No. 4,034,201 Dated July 5, 1977

Inventor(s) Henry J. Walter et al.

It is certified that error appears in the above-identified patent and that said Letters Patent are hereby corrected as shown below:

Claim 16, line 11, delete "adopted", insert -- adapted --.
Claim 16, line 17, delete "adopted", insert -- adapted --.
Claim 19, line 4, delete "adopted", insert -- adapted --.
Claim 19, line 5, delete "barel", insert -- barrel --.
Claim 23, line 2, delete "means".

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*